US005901396A

United States Patent [19]

Ahlskog et al.

[11] Patent Number: 5,901,396

[45] Date of Patent: May 11, 1999

[54] MODULAR BRIDGE DECK SYSTEM INCLUDING HOLLOW EXTRUDED ALUMINUM ELEMENTS

[75] Inventors: John J. Ahlskog, Corrales, N.M.; John Randolph Kissell, Durham, N.C.; Brian J. Malloy, Richmond, Va.; Adam D. Matteo, Richmond, Va.; Glen A. Taylor, Richmond, Va.; Kurt P. Thompson, Richmond, Va.; George B. Tyler, Richmond, Va.; Roman Wolchuk, Jersey City, N.J.

[73] Assignee: Reynolds Metals Company, Richmond, Va.

[21] Appl. No.: 08/887,789

[22] Filed: Jul. 3, 1997

Related U.S. Application Data

[62] Division of application No. 08/556,359, Nov. 13, 1995, Pat. No. 5,651,154.

[51] Int. Cl.[6] ..... E01D 19/12

[52] U.S. Cl. ..... 14/77.1; 52/783.1

[58] Field of Search ..... 14/73, 74, 74.5, 14/77.1, 6; 52/334, 783.1

[56] References Cited

U.S. PATENT DOCUMENTS

| | | | |
|---|---|---|---|
| 4,709,435 | 12/1987 | Stemler et al. | 14/73 |
| 5,033,147 | 7/1991 | Svensson | 14/73 |
| 5,651,154 | 7/1997 | Ahlskog et al. | 14/6 |

*Primary Examiner*—James Lisehora
*Attorney, Agent, or Firm*—Alan M. Biddison

[57] ABSTRACT

A light-weight, corrosion-resistant, readily installed bridge deck is formed of modular deck panels spliced to each other on site. Each of the deck panels is shop-fabricated by longitudinally welding flanges of adjacently placed multi-void extruded aluminum alloy structural elements. Transfer splices of longitudinally adjacent elongate elements are made by providing shear elements connecting individual elongate structural elements of each deck panel end-to-end prior to longitudinal welding of adjacent elongate elements, with the end joints between the elongate elements being arrayed in a staggered manner. A safety rail system is mounted to run alongside and above outer edges of the finished bridge deck mounted to a system of support girders.

3 Claims, 10 Drawing Sheets

MODULAR BRIDGE DECK SYSTEM INCLUDING HOLLOW EXTRUDED ALUMINUM ELEMENTS

This application is a division of Ser. No. 08/556,359 filed Nov. 13, 1995, now U.S. Pat. No. 5,651,154.

FIELD OF THE INVENTION

This invention relates to a bridge deck system, and more particularly to a bridge deck made from modular deck panels formed to selective shapes and sizes by shop-welding elongate hollow extruded aluminum elements with the panels being field-spliced to provide a readily assembled bridge deck supported on primary bridge girders which may act compositely with the deck panels and with cooperating curbs and safety rails.

BACKGROUND OF THE RELATED ART

As existing bridges and their roadway decks age they deteriorate due to the effects of repeated traffic loads, environment, loss of paint, and use of deicing chemicals and therefore need to be maintained with ever-increasing care, and in many cases must be replaced to ensure safety. Some older bridges were never designed to handle modern heavy truck traffic and are therefore structurally deficient. As populations grow, so does the volume of traffic. The consequence is that there is increasing pressure in the United States, and abroad, to modify and strengthen existing bridge structures and to develop more durable, less expensive, lower maintenance, lighter weight, and more easily assembled bridge structures for the future. There are also environmental concerns associated with application and removal of protective paint systems on steel structures which must be taken into consideration.

The typical bridge has a superstructure and foundation system by which a bridge roadway is supported at a desired elevation relative to adjacent terrain. As the moving loads of traffic traverse the bridge, the deck and the superstructure, eventually deteriorate. In some cases, the superstructure and foundations were never designed to support today's heavy trucks. A key factor in obtaining improved bridge structures therefore is to reduce the weight of the bridge deck without sacrificing strength, rigidity, durability, and the ability to cope with unusually heavy loads, accidents and the like. Traditional steel and concrete bridge decks are heavy and are subject to deterioration. Steel superstructures and reinforcing steel in concrete tend to rust and therefore require expensive anti-corrosion measures, inspection and/or painting. Steel orthotropic decks, while considered to be light in weight, are usually heavier than aluminum decks, require extensive welding and are fatigue sensitive. They are also quite flexible in the transverse direction, i.e., across the principal direction of traffic flow, which leads to wearing surface failures, and may be more expensive than aluminum.

Bridges typically consist of a superstructure and a substructure. The superstructure includes the deck and any members which support the deck that are oriented in a generally horizontal configuration. Bridge superstructures often include steel beams. When these beams run parallel to the length of the bridge (called the longitudinal direction of the bridge) they are referred to as girders or sometimes as stringers. Steel beams running transversely to the direction of traffic sometimes are also provided as part of the bridge superstructure.

Bridge decks are typically made of concrete with steel reinforcing bars, although some decks are made of steel plate with ribs on the underside running in the longitudinal direction. These steel decks are referred to as steel orthotropic decks because they have significantly different structural properties in the longitudinal and transverse directions. They are more costly than concrete decks but typically weigh less. One problem associated with steel decks is that the wearing layer typically applied on top of the upper steel, to provide a skid-resistant surface for traffic, often fails prematurely.

Concrete decks are typically cast in place at the bridge site. This requires a significant expenditure of time and labor to prepare the formwork and falsework needed to cast the concrete and to allow the concrete to cure. Steel and aluminum decks are fabricated off-site under controlled conditions and with more efficient labor in shops. Metal deck fabrication typically includes longitudinal and transverse splices between smaller parts that make up the deck. However, there are practical limits to the size of fabricated pieces that can be shipped. Therefore, steel and aluminum decks may also require longitudinal and transverse splices at the bridge site.

Serious consideration is therefore being given to the use of light-weight, corrosion resistant, easily-handled, aluminum deck structures. To reduce costs while ensuring high quality, attention has focused lately on forming the bridge deck in modular fashion, i.e., with initial construction being carried out in a shop or factory with the resulting modular elements being quickly and relatively inexpensively assembled in the field. Prefabricating "deck panels" or "deck slabs" from selected numbers of constituent elements also gives the bridge designer additional freedom in selecting the dimensions and form of the resulting bridge deck.

Examples of known bridge deck structures which variously address such needs include U.S. Pat. No. 4,709,435 to Stemler et al, U.S. Pat. No. 4,912,795 to Johnson, U.S. Pat. No. 5,033,147 to Svensson, and U.S. Pat. No. 5,414,885 to Berlin et al. These and other comparable prior art references teach different ways of forming bridge deck structures from component elements including extruded aluminum elements having hollow cross-sections, and the use of a wearing surface on an upper surface of the bridge deck.

The joints between adjacent elongate elements in the prior art, e.g., Svensson, are subject to flexing open and closed under loading, which can result in potential reflective cracking of the wearing layer. The joints between adjacent elongate elements in the present invention are welded, and so will not tend to produce cracks in the wearing layer when the deck is loaded. The Svensson elongate elements are clamped to the bridge girders. This method of attachment cannot be relied upon to transmit shear between the girder and the deck, since only an unquantified friction is available to transmit this shear. Thus, the benefits of composite action of the girders and deck cannot be realized. Also, since it is the practice of bridge engineers to assume that clamped joints will likely freeze up due to the accumulation of dirt or oxides, the deck and girder must also be designed as if shear were transmitted between them. This means that the bridge must be investigated for two conditions and the worst effects of the two used for the design. The Svensson type of structure also requires that holes be drilled in the bridge girders and that shims be driven between the deck and girders to anchor the deck at every joint between the elongate elements. This may be time-consuming and expensive.

There is, however, a continuing need for improvements which would increase the capacity of the bridge, reduce the cost (including the cost of assembling the structure from prefabricated modular elements), tolerate occasional overloads by overweight vehicles or caused by accidents or the like, and meet all applicable governmental standards and professional codes. The present invention is intended to meet such demands.

The present invention comprises an aluminum bridge deck. While somewhat similar to steel orthotropic decks in that they weigh less than concrete or filled grating, aluminum decks weigh even less than steel decks. Also, as will be explained further below, this invention teaches how aluminum decks can be made with essentially isotropic, rather than orthotropic, properties. With a continuous bottom flange and a continuous top flange, as in the preferred embodiment per FIGS. 10 and 12, for example, loads can be effectively resisted by two paths, i.e., in bending longitudinally and transversely to the length of the elongate elements. This is more structurally efficient than providing only one load path to resist loads. It is also redundant, and offers greater structural reliability. The net result is an essentially isotropic deck. Structural strength in this deck structure, in both shear and bending, is thus provided both longitudinally and transversely to the direction of traffic.

Other cross-sectional forms of the basic element from which such aluminum decks are formed provide varying combinations of advantages.

SUMMARY OF THE INVENTION

Accordingly, a principal object of this invention is to provide a light-weight, easy-to-assemble bridge deck system utilizing prefabricated deck panels which are field-spliced easily and inexpensively.

Another object of this invention is to provide a modular, easily-assembled, bridge deck incorporating prefabricated deck panels, made from hollow extruded aluminum elements, spliced together in the field.

It is yet another object of this invention to provide a readily assembled, light-weight and corrosion-resistant structure formed from hollow extruded aluminum elements which are field-spliced to each other with known fastening elements to provide a substantially continuous upper surface to which a wearing layer is applied for long-term use.

According to a preferred embodiment of this invention, there is provided an aluminum bridge deck system supported on a plurality of cooperating girders, which may act compositely with the aluminum deck system which includes a plurality of prefabricated deck panels which are longitudinally field-spliced together, each deck panel being formed by longitudinally shop-welding a plurality of elongate, multi-void, extruded aluminum elements which are transversely end-spliced in a staggered arrangement. A plurality of field-bolted nesting extrusions provide the longitudinal field-splicing of adjacent panels to each other. The longitudinal shop-welding comprises full-penetration, longitudinal top and bottom welds between respective top and bottom flanges of adjoining ones of the elongate extruded aluminum elements, whereby the welded top flanges of the field-spliced panels provide a substantially continuous upper surface.

The top flange of the decking is made substantially continuous and the bottom flange optionally may be made substantially continuous. Continuity of the bottom flange will provide the advantage of creating a bi-directional system having structural performance approaching that of an isotropic plate.

DETAILED DESCRIPTION OF THE PREFERRED EMBODIMENTS

Figure 1:
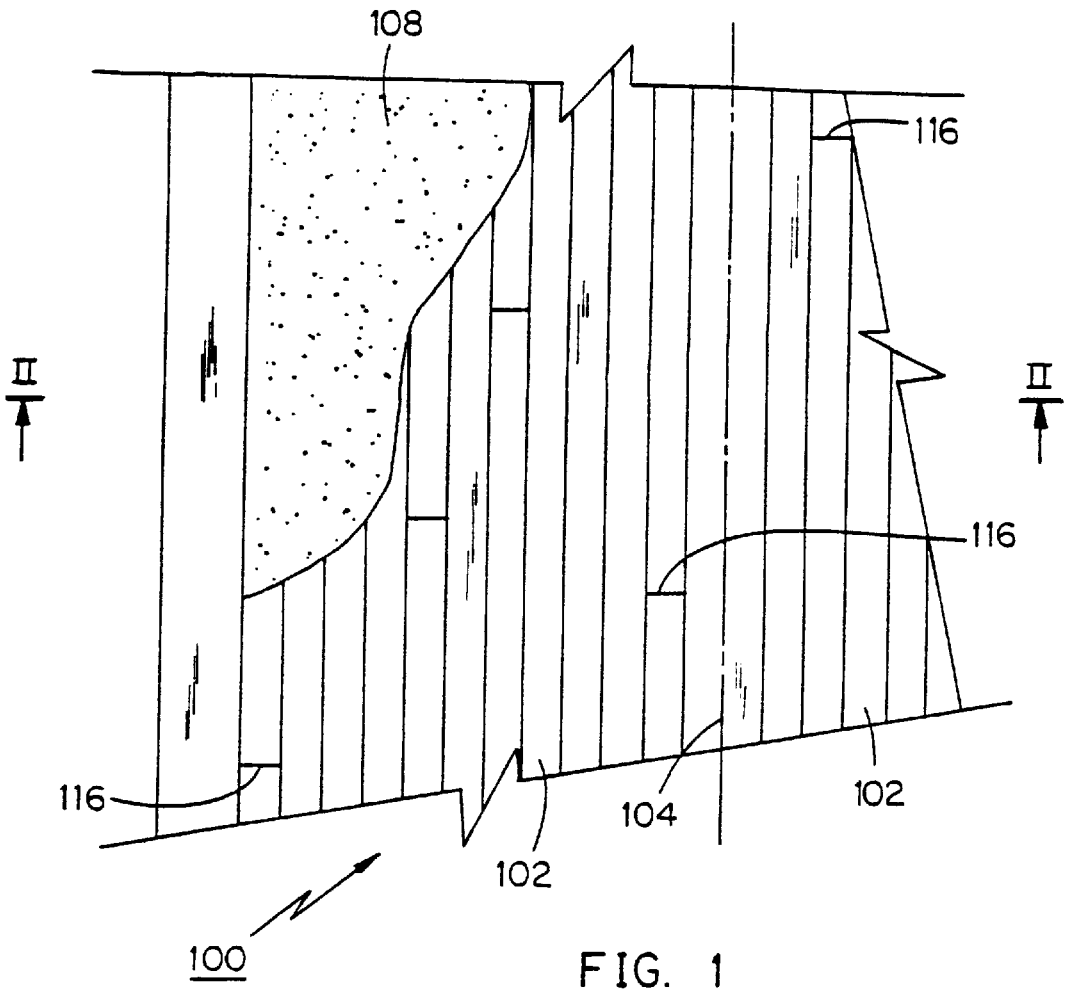
FIG. 1 is a partial plan view of a bridge deck structure according to a preferred embodiment.

As best seen in FIG. 1, in plan view an exemplary deck panel 100 according to the preferred embodiment includes a plurality of longitudinally adjacent elongate, multi-void elements 102. Note that no two immediately adjacent elongate elements 102 end at the same point except at the ends of the deck, i.e., these elongate elements are provided in a longitudinally staggered arrangement to minimize local reductions of strength or stiffness.

A preferred material for forming the multi-void elongate elements 102 is aluminum. It provides reduced weight, corrosion resistance without protective coatings, ease of manufacture to tight standards, reduced welding, bi-directional stiffness, resistance to wearing layer delamination, increased wearing layer adhesion, possible use of recycled material and overall economy of manufacture. By conventional extrusion techniques it is possible to produce such elements with voids of selected shape and dimension, defined by vertical and/or inclined webs between parallel upper and lower flanges, to quite substantial lengths. Consequently, individual bridge deck panels of suitable size can be readily manufactured, as described more fully hereinbelow, in a manner which permits ease of shipment, local handling, placement, and structural assembly and installation at the point of use.

Where an existing bridge deck structure has deteriorated, is live-load restricted, needs to be widened, or is to be otherwise modified, the old decking may be removed. Then, with minor modifications to the existing girder structure, the new deck according to the preferred embodiment of this invention may be readily installed. Preferred structures and techniques for doing so are discussed below. The key is to ensure that the bridge deck is mounted securely, with adjoining nodular panels securely spliced to each other so that the resulting structure is fully capable of handling anticipated traffic loads with the recommended factors of safety in accordance with existing industry standards and/or governmental codes.

Figure 10:
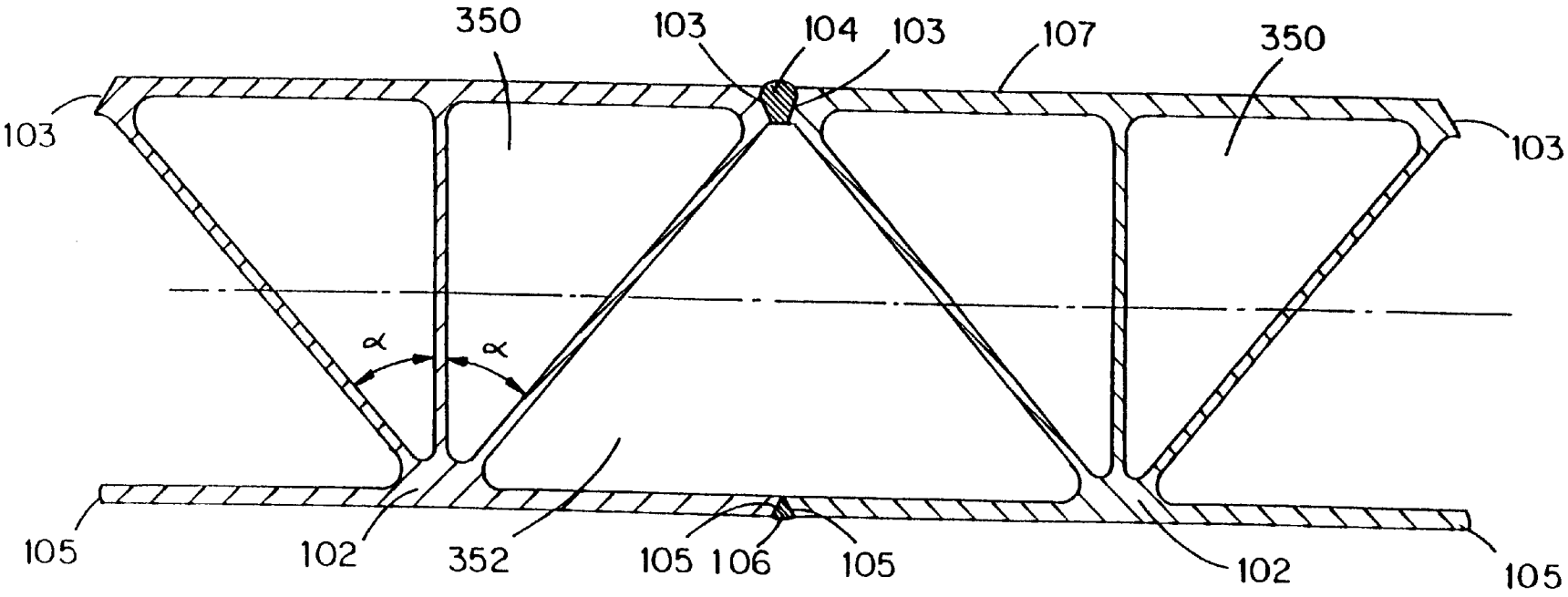
FIG. 10 is a partial transverse vertical cross-sectional view to illustrate details of the first of two preferred elongate elements which, when welded together form an essentially isotropic plate. Two such elongate elements are shown together to illustrate the one-side, full-penetration, longitudinal welding between the respective top and bottom flange portions of adjacent multi-void extruded aluminum elements forming a deck panel according to the preferred embodiment.
Figure 12:
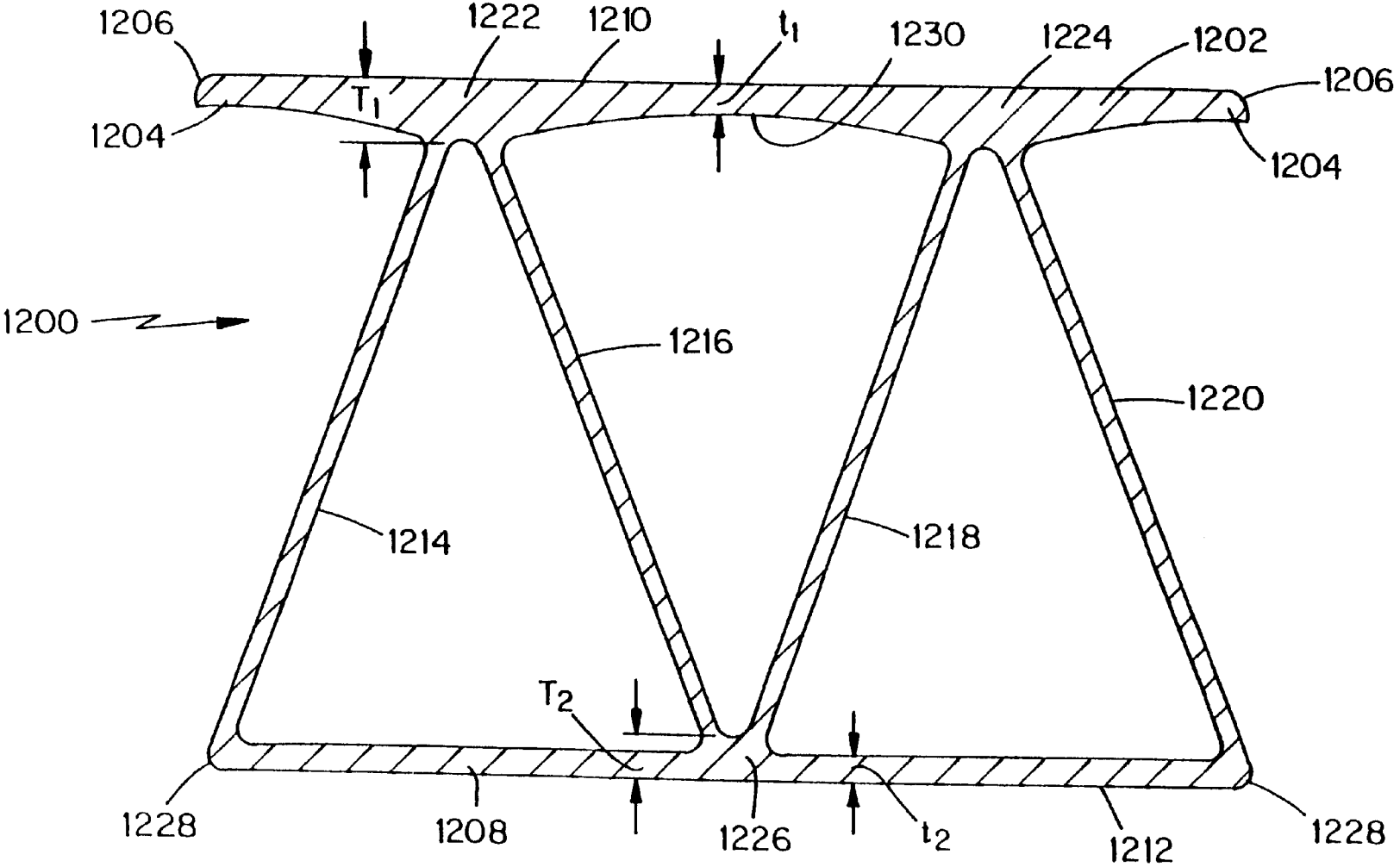
FIG. 12 is a partial cross-sectional view of the second of two alternative forms of elongate elements which, when welded together, form an essentially isotropic plate.
Figure 13:
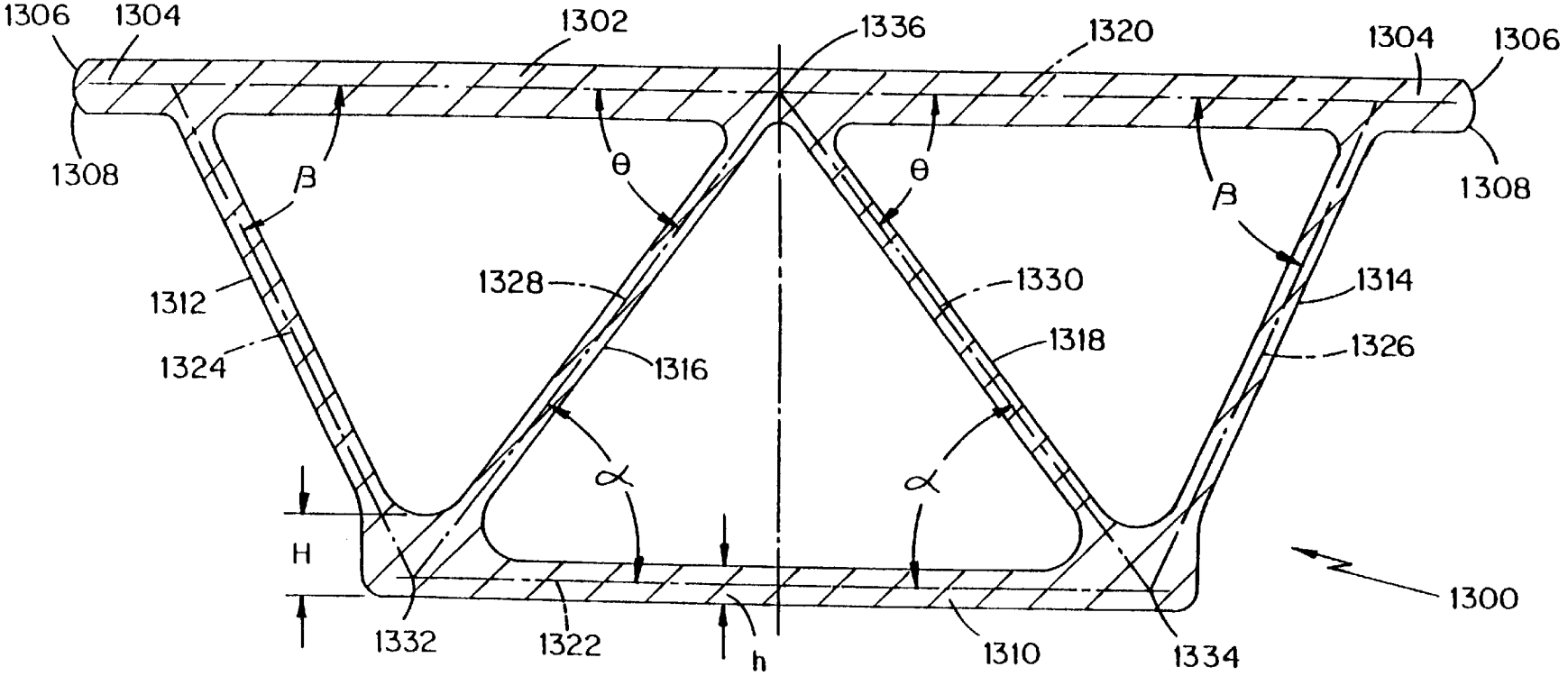
FIG. 13 is a cross-sectional view of yet another alternative form of elongate element having four inclined webs between two parallel but unequally wide parallel flanges. This particular embodiment allows for two-side welding and will provide an orthotropic deck.

Elongate elements 102 preferably are made of aluminum alloy 6063-T6 or other similar alloys, having good structural properties and excellent resistance to chlorides and other similar corrosion-causing chemicals without the need for painting as is common with steel structures. The overall depth and geometry of the bridge deck 100 must be selected in light of the anticipated loads and must provide an ample second moment of area and section modulus to span typical girder bridge configurations with minimal superstructure modification, particularly where existing structures are being replaced by a structure according to this invention. Reference to FIGS. 10, 12 and 13 will clarify how the preferred cross-sectional shape of the exemplary extruded elongate elements 102 comprises webs which are perpendicular or inclined to upper and lower flanges to define elongate voids of essentially triangular cross-section. As explained below with detailed reference to the embodiment per FIG. 12, element 102 in transverse cross-section teaches "perfect triangulation". Likewise FIG. 10, element 102 in transverse cross-section teaches perfect triangulation except for element 110 which has been added to stabilize and stiffen flange 107. For decks utilizing a large element 102 in transverse cross-section, such section as shown in FIG. 10 represents very efficient design requiring less aluminum material to develop the necessary strength and rigidity of the top flange.

When the bridge deck structure is complete, these extrusion voids are closed off at their outer ends to prevent animal infiltration and settlement of debris therein. Even the other embodiments of the basic elongate element are similarly closed off after installation of the deck to avoid debris accumulation therein.

The relatively low density of aluminum alloy allows forming of light-weight deck panels 100 weighing approximately 20 lbs. per sq. ft (in plan), thus allowing easy handling even of very large deck panels. The inherent strength and stiffness of such a structure is also believed to be capable of increasing live-load capacity for existing or new bridges since it may be replacing concrete decking weighing in the order of 100 to 150 pounds per square foot.

Transverse splices are made in the shop between longitudinally end-to-end adjoining elongate elements 102, in a staggered configuration, prior to shop-welding longitudinally along the top and bottom flanges of the elements 102 to form individual deck panels 100. In keeping with the modular concept, this technique and structure both allow for strategic placing of the end-to-end connections, thereby dispersing local connections and eliminating the need for one global rigidity transition. This structure and technique also permit more efficient use of the elongate aluminum alloy extrusions, thereby reducing material wastage.

The typical deck panel 100 according to this invention, to the desired size and form, is best manufactured in a shop, by welding together adjacently placed longitudinally spliced elongate extruded elements 102. The use of the prefix "shop-" to characterize welding, assembly, or the like is thus intended to identify an important aspect of the present invention. This is the creation of modular elements such as the deck panel under controlled conditions, with the use of well-understood and calibrated welding equipment or the like, to ensure consistently high-quality welding, thorough inspection, and safe storage in inventory until the deck panels are needed. This should be as distinguished from steps taken to complete the desired structure in the "field", i.e., at a structural site in possibly inclement weather and in the face of other local hardships. Field-welding is heavily discouraged by many government agencies associated with bridge construction.

Shop-welding of the elongate extruded elements 102 allows the formation of a variety of geometries and slope transitions in the finished deck. It is implicit in the present teaching that the elongate extruded elements 100 need not necessarily and at all times be perfectly straight but may, by the use of conventional equipment, be formed to have desired curvatures or angulation to suit specific needs.

As best understood with reference to FIG. 10, two laterally adjoining elongate extruded elements 102, 102 with their respective upper and lower flanges parallel allow the formation of elongate one-side full-penetration welds 104 and 106 to permanently bond together their respective upper and lower flanges. Elongate elements 102, 102 are preferably formed with beveled upper and lower outer edges 103, 103 in the upper flanges and 105, 105 in the lower flanges, to accommodate the deposited weld metal of welds 104, 106, respectively. When two elongate extruded elements 102, 102 are thus welded to each other there is formed between them, by the welding, a relatively large, essentially triangular cross-sectioned void 352.

Each elongate element 102 preferably has a cross-section, as per FIGS. 10 and 12, in which two parallel flanges each have beveled outer edges and are interconnected by a series of webs, which may be inclined or vertical, but which always define voids of essentially triangular cross-section. Within an elongate element 102 and again between elongate elements after they are connected. It is the two inclined webs that define the most efficient structural system for the decking, i.e., the repeating triangles. The repeating triangles are the characteristics that makes the deck composed of elements shown in FIGS. 10 and 12 an essentially isotropic, rather than an orthotropic system. The centerlines of the webs and flanges intersect one another in forming these triangles, creating a truss in the direction perpendicular to the elongate elements 102. These intersecting centerlines allow the top and the bottom flanges to become engaged in resisting bending perpendicular to the elongate elements 102 without creating localized bending in the webs or flanges. While the embodiment according to FIG. 13 provides substantial bending strength in the direction of the extrusion, it is an essentially orthotropic system because the repeating, truss-like triangles are discontinued at top flange splices between elongate elements 102 and bottom flange continuity that is exhibited in the system according to FIGS. 10 and 12 is not provided in a system consisting of extrusions according to FIG. 13. The vertical web in the embodiment according to FIG. 10 helps to stiffen the top flange of the elongate element and eventually the deck by reducing the span between the inclined webs. This also enhances the durability of the wearing layer 108 by reducing local deflections. The inclined webs 316 preferably are each inclined relative to the parallel top and bottom flanges at an angle in the range about 30° –70°.

The one-side full penetration welds 104, 106, properly formed under shop conditions, allow for smooth stress transfer between the upper and lower flanges of the welded together elongate elements 102, 102. Also, because of the formation of the essentially triangular void of cross-section 352, it becomes easy to inspect the resulting welds 104, 106 from both sides of the deck.

The top flange of each elongate element 102 has an upper surface 107 and, with the top surface of elongate weld 104, the combination of a plurality of such elongate elements provides a continuous upper surface of the bridge deck panel 100. By suitable selection of the thickness of the various flanges and webs, a competent designer can optimize weight reduction and cost while ensuring the desired strength in the resulting structure. Since this would depend on the properties of the alloy or material actually employed, and because this would be within the competence of persons of ordinary skill in the art, detailed calculations relating to such thicknesses are not included herein.

The combination of the upper and lower flanges and the perpendicular and inclined webs therebetween also serves to provide significant stiffness to the deck so that it will resist bending in directions both parallel and perpendicular to the traffic. The upper substantially continuous surface 107 also provides a suitable base to which is applied a wearing layer 108 formed of any suitable wear-resistant material. Epoxy compounds of known type, blended with aggregate preferably of a size in the range 0.05–0.25 in., are considered particularly suitable for this purpose and the final thickness of such a wear layer 108 can be selected in light of the anticipated traffic loads and manufacturer's recommendations.

Figure 2:
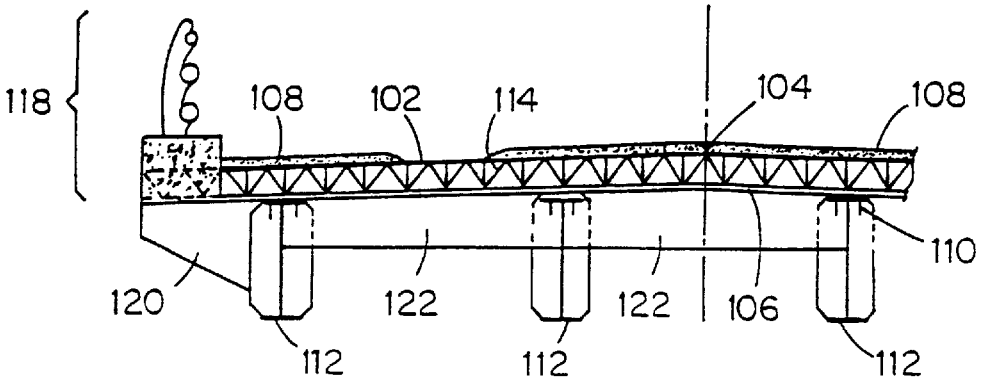
FIG. 2 is a vertical cross-sectional view of the structure of FIG. 1, at Section II—II therein.

The connections between adjacent bottom flanges of the elongate elements 102 of each deck panel 100 also provide a continuous substantially flat bottom surface at which the deck panel may be strongly connected to suitable support members 110, as best seen in FIG. 2.

The resulting bridge deck need not be absolutely rectangular in plan view, because curved bridges occasionally are provided in curved roads. This may also require banking and/or crowning of the resulting deck wearing surface and the road surface to ensure proper drainage of rain therefrom.

The thickness of the bottom flange portion of the elongate elements 102 must be selected in light of the strength of the material and the anticipated need for adequate bearing strength both for fastening the deck to the support structure 110 and to ensure adequate resistance to forces and distortional effects caused by foreseeable loads, with adequate factors of safety.

The deck-to-girder connection at support 110 should allow each deck panel 100 to fully engage the underlying girder 112 to develop a substantially integrated bridge assembly in which the deck and girders act compositely to support all foreseeable loading with approved factors of safety. Such a connection will provide what is referred to in the industry as "composite action", which results in enhanced overall rigidity and strength. A manner of forming the desired connection between such a deck panel 100 and an underlying girder is discussed below with reference to FIG. 6.

With bridge roadway widths generally exceeding the width of deck panels which can be conveniently transported, there is a need to field-splice together adjoining deck panels 100, 100 to each other along the outermost elongate structural element 102 of each. This is discussed below with particular reference to FIGS. 3A and 3B.

Figure 8:
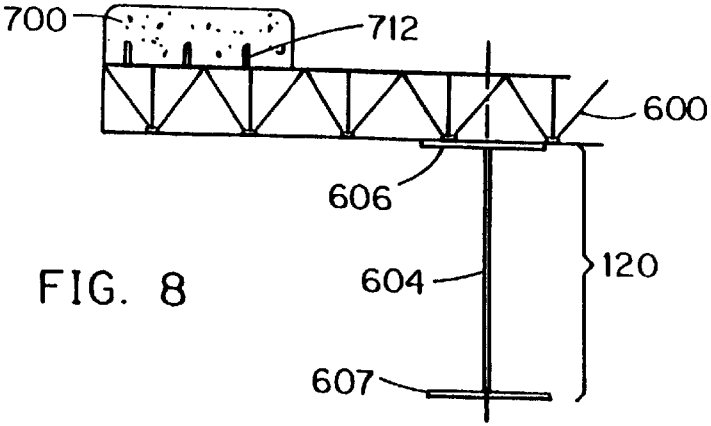
FIG. 8 is a vertical schematic cross-sectional view of the bridge deck at Section VIII—VIII in FIG. 7.
Figure 9:
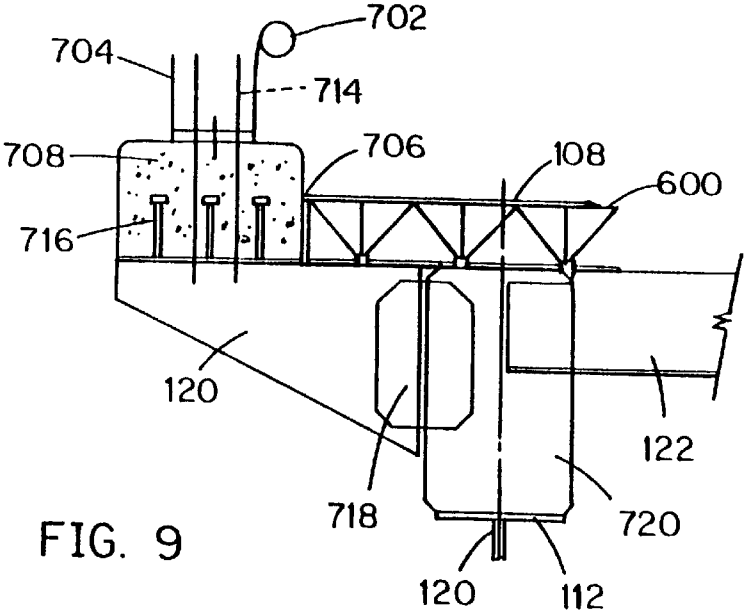
FIG. 9 is a cross-sectional view taken at Section IX-IX in FIG. 7, to illustrate a preferred manner of supporting a curb and safety rail structure cooperating with the bridge deck.
Figure 7:
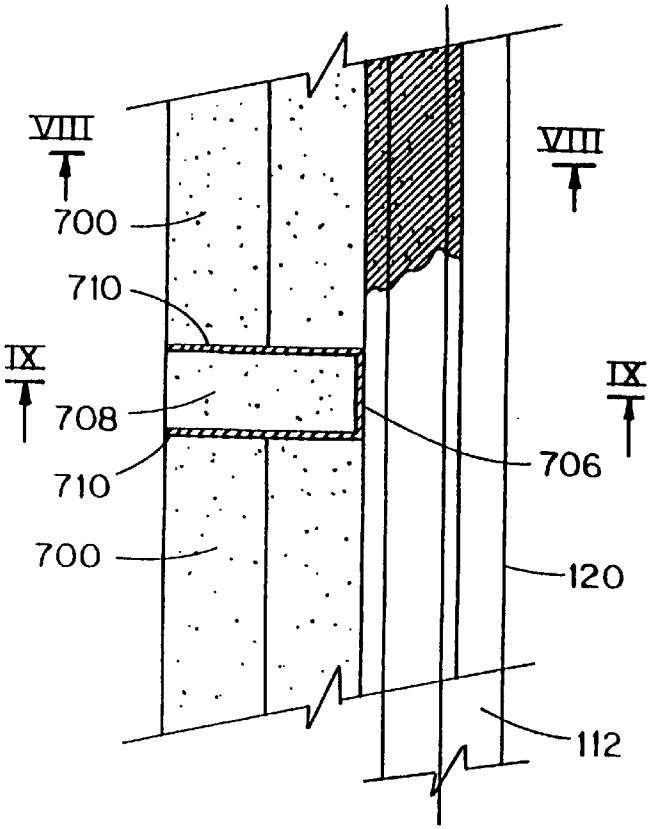
FIG. 7 is a partial plan view of a side portion of a bridge deck along which is provided a concrete curb and means for supporting a safety rail system.

When a bridge structure is created, it often is necessary to provide a curb and a safety railing structure to prevent disastrous falling-off from the bridge of vehicles and/or persons or disastrous redirection of errant vehicles due to accidents. In providing such features as curbs and safety rail systems, it is desirable to avoid direct connection between such elements and the deck panels formed according to the present invention. A vehicle which impacts with the curb and/or safety rail system, must be successfully prevented thereby from falling off the bridge. It is structurally and economically preferable that any damage to the curb and/or safety rail system under such a foreseeable circumstance be all that must be remedied. If there is a direct physical connection between the curb and/or safety rail system and the deck panels there could be permanent deformation and/or intolerable stressing of the deck panel locally. Such damage could become expensive and might require interruption of traffic over the bridge to allow repairs. Accordingly, as best seen in FIG. 2, it is preferred to provide a plurality of suitably spaced cantilever brackets 120 supported by the girders 112 to provide a suitable base for mounting thereon of curb and bridge rail system 118 comprising an elongate curb supporting a bridge rail mounted thereon or a reinforced concrete barrier. This is discussed further with particular reference to FIGS. 7–9 below. Shear studs 716 may be provided between a concrete pedestal 708 and the underlying cantilever brackets 120 in accordance with conventional bridge construction practice.

As best seen in FIG. 2, a transverse diaphragm 122 may be provided periodically to further strengthen and stiffen the overall bridge structure. The same applies to sudden impact forces experienced by the pedestal and bridge rail structure 118, i.e., these would be transferred via the cantilever bracket 120 to the immediately supporting girder 112 and, by way of the diaphragm 122, simultaneously to other cooperating girders.

To summarize, the preferred embodiment of this invention provides a bridge deck formed from a plurality of interconnected and cooperating deck panels, each comprising a staggered arrangement of longitudinally shop-welded elongate multi-void elements preferably formed of extruded aluminum alloy. Adjoining deck panels are connected to each other as described more fully hereinbelow, and the resulting deck structure is firmly mounted to supporting girders or the like. A curb and safety rail system may be provided along each side of the bridge deck but not necessarily with direct connection thereto. The uppermost surface of the bridge deck is preferably provided with an epoxy-containing wear layer upon which the traffic will travel. In the bridge building industry the term "wearing layer" as used herein may be referred to as the "wearing surface".

Figure 3A:
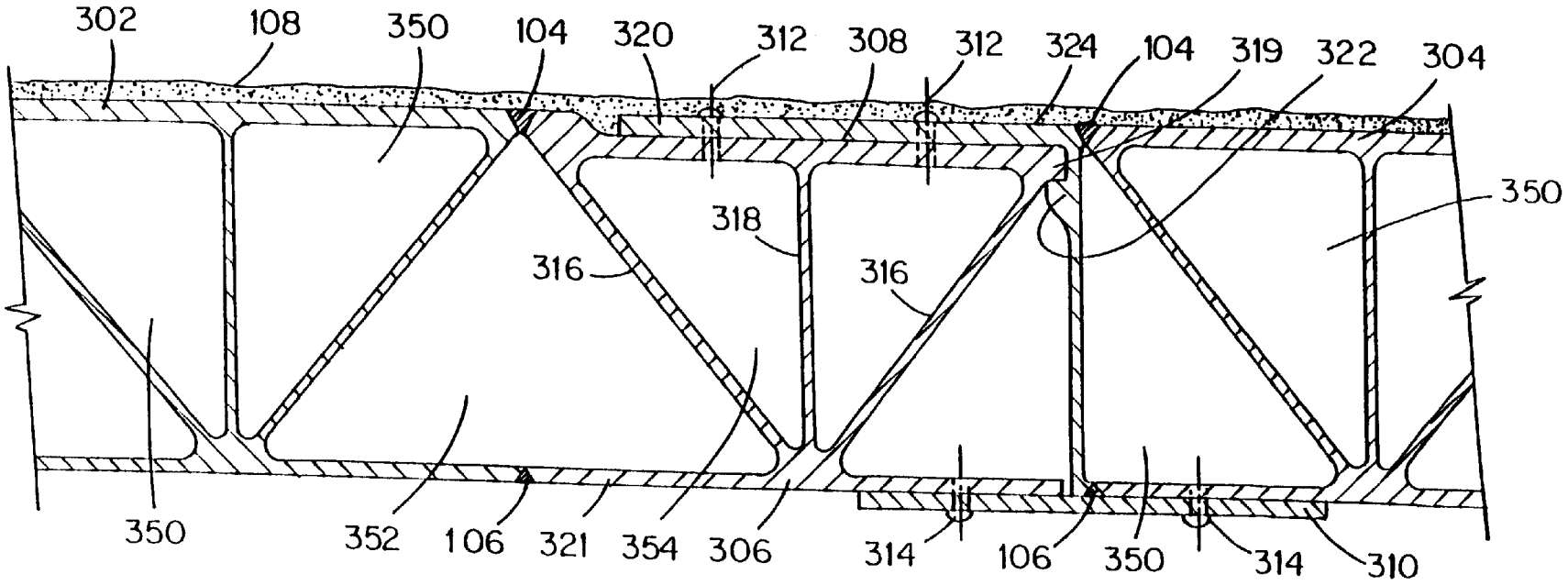
FIG. 3A is a vertical transverse cross-sectional view of the bridge deck structure according to FIG. 1 at a location where two adjoining modular deck panels are field-spliced to one another and thereafter coated with a shared wearing layer.
Figure 3B:
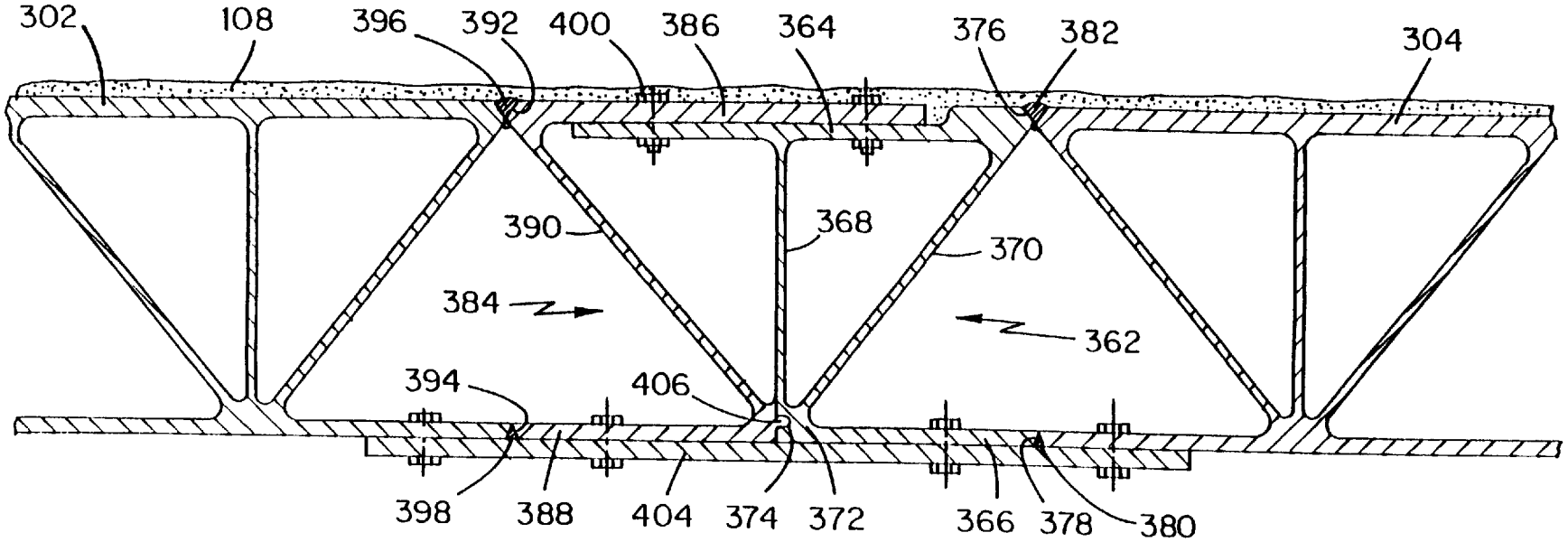
FIG. 3B is a similar transverse cross-sectional view to explain an alternative structure and method for field-splicing similar decks.

As best seen in FIGS. 3A and 3B, two longitudinally adjoining exemplary deck panels 302 and 304 may be securely connected to each other in the field, without compromising structural integrity. In a first embodiment, per FIG. 3A, this is done by means of a splicing system involving first and second splice elements 306, 308 shop-welded to the two deck panels 302, 304, respectively. Such longitudinal splicing may often be necessary because the prefabricated aluminum deck panels 302, 304 may often be limited in width by shipping constraints. FIG. 3B shows an alternative splicing system.

As best seen in FIG. 3A, a longitudinal field splice according to one preferred embodiment is performed by shop-welding to prefabricated deck panel 302 an elongate first splice element 306 which has an upper flange 320 and a lower flange 321, the flanges having beveled or tapered side edges in much the same manner as elongate elements 102, 102. There is also provided a second elongate splice element 308, of generally L-shaped cross-section, which is shop-welded to an adjacent side of deck panel 304. These elongate first and second splice elements 306, 308 are preferably formed by extrusion of the same material, e.g., a selected aluminum alloy, as elongate elements 102, 102. The connection between the respective splice elements and the corresponding outermost elongate elements of adjoining deck panels 302, 304 is effected by one-side full-penetration welds 104, 106 just as were employed in connecting adjacent elongate elements 102 to form the deck panels 302, 304, respectively. Once the splice elements are thus welded to the corresponding sides of the adjoining deck panels under shop conditions, the adjoining deck panels are field-spliced as shown in FIG. 3A.

Furthermore, in the embodiment of FIG. 3A, a flat elongate splicing plate 310 is positioned beneath the bottom flange of the elements 306, 304. With these elements correctly assembled, with the uppermost outer edge portion of first splice element 306 fitted to an elongate shear key 322 of the second splice element, a plurality of holes is drilled both at the top and the bottom portions of the deck panels. The purpose is to form the holes under shop conditions in element 308 so that when the bridge deck is to be assembled under field conditions the workers simply match drill the holes in element 306 using the predrilled hole in 308 to ensure proper bolting tolerances. The field-connection is made by known one-side connection elements such as bolts 312, 312 passed through the upper flanges and bolts 314, 314 through the spliced plate into the bottom flanges. Thus, bolts 312, 312 each provide strong field-installed connections between the upper flanges of the first and second splice elements and, by their respective welding to adjoining deck panels, between the latter. Similarly, bolts 314, 314 respectively connect the first splice element 306 to splicing plate 310 and the splicing plate 310 to the lower flange of the outermost elongate element of deck panel 304.

In the manner described above, there is provided a strong field-installed splice at relatively low expense, in terms of both material and skilled labor, between adjoining deck panels in the longitudinal direction.

The inclined webs 316, 316 of the triangulated first splice element 306 act as members of a truss, continuing the triangulated trusses of both adjoining deck panels being connected 302, 304 which allows for the efficient transfer of forces in bending in a direction perpendicular to the length of the splice element 306. The vertical web 318 of the first splice element 306 provides local support for the top flange 320 thereof, which controls the localized flexure and stress in the top flange.

When the L-shaped second splice element 308 is shop-welded to the prefabricated deck panel 304, it provides shear strength throughout the spliced joint by use of the shear key 322 which engages the outermost upper edge of the triangulated first splice element 306 and thus of prefabricated deck panel 302.

Bending strength through this joint is provided by the top flange of the L-shaped second splice element 308 which is bolted to the top flange 320 of the triangulated first splice element 306 and by the bottom flange connected to the splice plate 310. The top flange 324 of the L-shaped second splice element 308 fits into what is formed as a recessed top flange 320 of the first splice element 306, thus creating an uppermost surface which is deliberately made flush with the top surfaces of the upper flanges of the two adjacent prefabricated deck panels 302, 304. This provides a continuous relatively smooth upper surface for application thereon of a wearing surface 108 to support traffic.

Because the various bolt holes are pre-drilled into element 308 in the shop and then match-drilled in corresponding element 306 in the field, the only other field operations required are bolt installation, and subsequently the application of the wearing layer 108. This allows for rapid field installation, which in turn reduces traffic delays and overall project costs.

The L-shaped second splice element 308 is a simple solid shape free of any hollows, hence it requires a much less expensive extrusion die than do elements which contain hollows, and is thus less expensive to extrude.

A groove is formed at the shear key 322 in the arm of the L-shaped second spliced element 308, and is shaped and sized to closely receive therein the upper outermost edge portion 319 of the first splice element 306. This allows for precise and easy fitting together of laterally adjoining deck panels in the field.

FIG. 3B relates to an alternative way of splicing together two longitudinally adjoining deck panels 302, 304 in the field. This is done by employing a first elongate, preferably extruded aluminum, splicing element 362 which has an upper flange 364, a lower flange 366 parallel to upper flange 364, a vertical web 368 which is perpendicular to parallel flanges 364 and 366, and an inclined web 370 which is integral with the upper flange 364 at one edge thereof and which joins with web 368 and lower flange 366 at a common junction 372. An elongate groove 374 is formed in web 368 at the junction 372 and may have any suitable cross-section, e.g., trapezoidal, semi-circular, square, etc.

A beveled surface 376 is provided at and along an uppermost edge portion where inclined web 370 and upper flange 364 join. This beveling preferably extends at an inclination (preferably of about 60° to the parallel flanges) and to a depth comparable to the beveling provided on the upper corner edge of the outermost longitudinal elongate element of deck 304. Beveled surface 376 cooperates with the counterpart beveled surface of the upper edge portion of deck 304 to form a V-shaped groove within which weld metal is deposited. Similarly, there is also provided a beveled edge portion 378 at an outer distal edge of lower flange 366, to cooperate with a counterpart adjacently located beveled surface of the lower flange of the outermost elongate element of deck 304. Accordingly, there is provided another elongate V-shaped space within which weld metal may be deposited to weld together the lowermost adjacently disposed flanges of deck 304 and splicing element 362 at 380. The welds at 380 (between the lower flanges) and 382 (between the upper flanges) serve to provide a very solid, secure and durable connection which maintains the essentially triangulated structure between splicing element 362 and deck 304.

A ridge 406 shown in FIG. 3B is provided to the second splicing element 384, of a shape, size and location such as to closely fit into groove 374 of the first splicing element 362 to properly align adjacent deck panels 302, 304 to each other as shown in FIG. 3B. Thus after splicing elements 362 and 384 have been respectively welded to decks 304, 302, the fitting together of ridge 406 into groove 374 aligns the deck panels correctly for match drilling of holes (not numbered) to receive bolts 400 and 402 as shown.

There is also provided a second and cooperating splicing element 384 which has a generally Z-shaped cross-section (seen in mirror image in FIG. 3B), which comprises an upper flange 386, a parallel lower flange 388 and a transverse inclined web 390 connecting the two to form the Z-shape in cross-section. Beveled edge surfaces 392 and 394 are respectively provided at the junction of upper flange 386 and web 390 and at the outermost edge of lower flange 388. These have the same form and function as described earlier, i.e., to receive weld material. As seen in FIG. 3B, the upper beveled surface 392 of splicing element 384 cooperates with a counterpart adjacent beveled surface of deck 302 to form a V-shaped place in which weld metal 396 is deposited to unite second splicing element 384 and deck 302. Similarly, the lower beveled edge surface 394 of lower flange 388 cooperates with the adjacent counterpart beveled surface of the lower flange of the outermost elongate element of deck 302 to form a second V-shaped region which may be filled with weld metal to form weld 398. The welds 396 and 398 thus provide solid, durable, and effective load-transmitting connections at the upper and lower flanges between the second splicing element 384 and deck 302.

As readily seen in FIG. 3B, the sizing and shapes of the first and second splicing elements 362, 384 are selected so that the uppermost surface of upper flange 386 of the second splicing element 384 is coplanar with the upper surfaces of decks 302 and 304. Similarly, the lower outer surfaces of lower flanges 366, 388, of first and second splicing elements 362, 384, are also coplanar with the lower surfaces of decks 302, 304.

A plurality of suitably spaced-apart bolts 400, 400 are provided through field-matched holes drilled into the upper flanges 364, 386 of the first and second splicing elements to thereby unite decks 302, 304 at their upper portions. Similarly, pluralities of bolts 402, 402, passed through suitably spaced-apart and field-drilled holes may be employed to strongly connect lower flanges 366, 388 of the first and second splicing elements 362, 384 to a common elongate flat splicing plate 404, to thereby strongly unite the lower flanges of decks 302, 304 to each other. The heads of these bolts may be countersunk, if desired.

Alternative methods of splicing elements 302 and 304 by means of regular high strength steel bolts are also possible.

A wearing layer 108 may then be applied, as previously discussed, on the top surface of the now united decks 302, 304 to provide a continuous, long-wearing, friction surface on which traffic may traverse the decks.

The purpose of strongly splicing together adjacent deck panels is to ensure that the desired isotropic performance of the total bridge deck is realized as closely as possible. Persons of ordinary skill in the art will appreciate that in both of the techniques for longitudinally splicing adjacent deck panels, as illustrated in FIGS. 3A and 3B and as discussed above, the provision of suitably inclined and perpendicular transverse webs results in a light-weight structure capable of isotropically transmitting bending and shear loads through and between spliced-together adjacent deck panels in both the longitudinal (i.e., traffic) and transverse directions.

Figure 4:
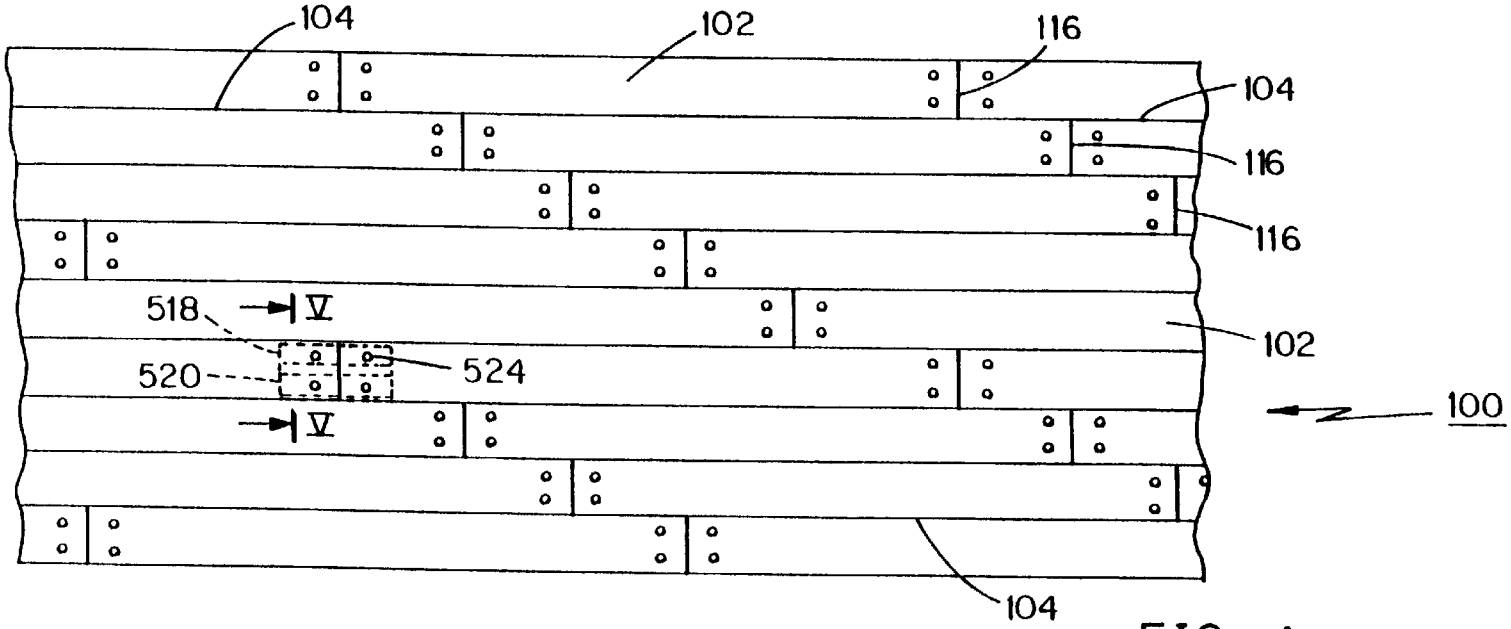
FIG. 4 is a plan view of a multi-element deck panel according to the preferred embodiment.
Figure 5:
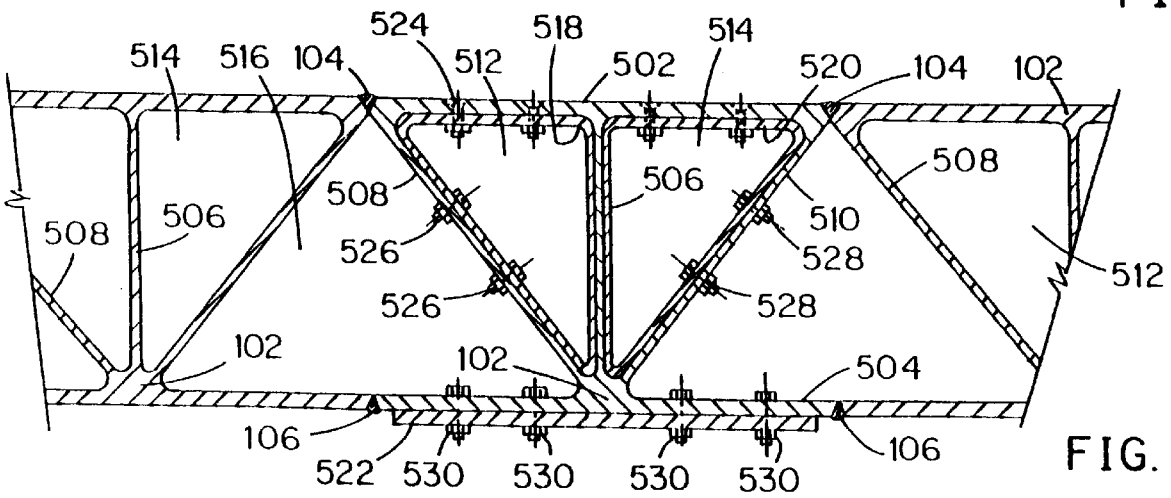
FIG. 5 is a transverse cross-section at Section V—V in FIG. 4, to illustrate the use of longitudinal triangular cross-section shear elements for staggered connection of elongate extruded elements of the deck panel according to FIG. 3A.

As best seen in FIG. 4, each deck panel 100 comprises a number of longitudinally adjoining elongate elements 102, 102 which are spliced together with their ends distributed in a staggered manner, with laterally adjoining elongate elements being welded at their respective upper and lower flanges by full penetration welds 104, 106. FIG. 5 shows details of how longitudinally adjoining elongate elements 102, 102 are shop-spliced to each other in forming each deck panel.

Individual elongate elements 102 may be pre-cut to specified lengths to create a desired deck panel layout. As shown in FIG. 5, in this particular embodiment, each elongate element 102 has an upper flange 502, a parallel lower flange 504, a web 506 perpendicular to the upper and lower flanges, and inclined webs 508 and 510 connecting the flanges as shown. This creates elongate, essentially triangular cross-sectioned voids 512 and 514. When two laterally adjoining elongate elements 102, 102 are welded by welds 104 and 106, there is also created an elongate essentially triangular cross-sectioned void 516. This plurality of webs and welded elongate elements creates a light-weight, stiff and structurally strong deck panel 100.

The ends of two longitudinally adjoining elongate elements 102, 102 are extended or shop-spliced together by inserting through their immediately adjacent ends a pair of essentially triangular cross-sectioned shear elements 518, 520. In FIG. 4, the disposition of the shear elements 518, 520 is indicated by broken lines. As best seen in the transverse cross-sectional view of FIG. 5, shear elements 518, 520 are shaped and sized to be closely received within the elongate voids 512, 514, respectively, of each of two longitudinally adjoining elongate elements 102, 102. In addition, there may be provided a flat bottom flange splice plate 522 directly beneath the end portions of the bottom flanges of the two longitudinally adjoining elements 102, 102.

Strong physical connection between shear elements 518, 520 and elongate elements 102, 102, as well as between the bottom flange splice plate 522 and the same elongate elements 102, 102, is provided by a plurality of connection elements such as bolts. Holes of suitable size to locate these bolts 524, 530 are provided through the upper flange 502 and the corresponding adjacent portion of each of shear elements 518, 520. To ensure that there is an essentially flat upper surface formed in the resulting deck panel, countersunk holes are formed in the upper flange 502 for taperedhead bolts 524. Other holes are provided for fitting therethrough of bolts 526 and 528 through the inclined walls or webs, as shown in FIG. 5. These web connections may also be made on one side of the splice only, prior to joining the ends of 102. Shear to the other element 102 may be transmitted by friction between tightly fitted elements. Holes are also provided for bolts 530 passed through bottom flange 504 and bottom flange splice plate 522. All of this is done under shop conditions to ensure precise fitting together of the connected elements and to permit the necessary inspection to ensure quality control.

The elongate elements 102 typically are shorter than the final deck panel 100 formed therefrom. Longitudinal splicing of the elongate elements 102 in successive end-to-end connections by shear elements 518 and 520 and by bottom flange splice plate 522 creates elongate ribs of the desired length and these are then welded together by welds 104, 106, with elongate element ends in staggered array (see FIG. 4) to form the deck panels 100.

The above-described splicing is performed as many times as necessary, depending upon the desired length and width of the final deck panel to be formed. Since such deck panels can be easily made to a length of 100 ft. or longer, a single deck panel may suffice for a relatively short bridge without field splices. In the alternative, depending upon the chosen support system beneath the bridge deck, each deck panel may be oriented transversely to the direction of traffic and a number of such deck panels may be needed with the width of the bridge determined by the length of each deck panel. In any case, the end-to-end spliced elongate elements constitute shop-prefabricated ribs which are then welded together, also in the shop, at the top and bottom flanges 502 and 504 by full penetration welds 104 and 106, respectively, to form the prefabricated panel of selected length and width.

Note that the staggered connection structure allows individual elongate elements 102 of limited length, determined by the size and capacity of the extrusion press employed, to be fabricated under controlled shop conditions into significantly longer deck panels 100 without substantially sacrificing deck strength. Since the locations of these splices are staggered, no weak planes are created through the deck width by the spliced joints. By splicing the elongate elements 102, 102 at their ends in this manner prior to welding them to each other along their upper and lower webs, high quality welds can be formed continuously along the entire panel length. Such continuous full penetration welds allow for effective transfer of bending moment across the spliced connections through both the upper and lower flanges 502, 504 for each elongate element 102. The thicknesses of the upper and lower flanges 502, 504 of elongate elements, if made of aluminum alloy, preferably are in the range 0.3–0.75 in. The full penetration welds 104, 106 therefore also are of comparable depth.

Furthermore, by splicing the elongate elements 102, 102 prior to such welding, easy visual access for inspection is enabled at both sides of the bottom flange and other regions of interest. This also greatly facilitates the forming of the holes to receive the various bolts and the subsequent bolting together of the triangular cross-sectioned shear elements 518, 520 as described above. These shear elements allow for the transfer of shear forces between the ends of the pair of longitudinally adjoining elongate elements. Such easy access also allows the fabricator of the bridge deck to bolt the bottom splice plate to the bottom flanges of two laterally abutting elongate elements 102, 102 and provides additional bending strength to such a joint. Note that bolting together the top flanges 502 and the upper portions of the triangular cross-sectioned shear elements 518, 520 also adds to the strength of the structure when subjected to bending forces.

Since the entire above-described splicing and fabrication process is performed under shop conditions, allowing detailed inspection and consistent quality control, the resulting assembly and welding ensure that each deck panel has strong, weather resistant and dirt-impervious joints.

As noted above, the interconnected deck panels forming the bridge deck must be securely mounted to support structures, e.g., a plurality of cooperating bridge girders. To ensure against corrosive damage to the material of the deck panels due to bimetalic effects, the top surfaces of steel girders are preferably coated with a protective coating wherever contact will be made with the deck material. If the aluminum is to be placed in direct contact with uncured concrete then the aluminum may need a protective coating. Note that aluminum girders could be provided in place of conventional concrete or steel girders. However, when existing support structures are to be utilized, e.g., in replacing an existing deteriorated bridge deck or in expanding the same, steel girders are more likely to be encountered. To the extent possible, it is desirable to entirely remove old concrete to which the previous bridge deck was anchored. Similarly, to ensure a structurally sound and easily achievable connection which is compatible with existing girders, it is preferable to anchor the invented bridge deck to the tops of such girders via a flowable and curable medium capable of transferring shear, e.g., epoxies, resins, concrete, or grout. For secure load-transferring connection, a plurality of aluminum shear engagement devices such as studs or angle-section short metal elements may be used. Such aluminum shear engagement devices may also be coated with a protective coating, to reduce the likelihood of corrosion and consequently shortened life.

Figure 6:
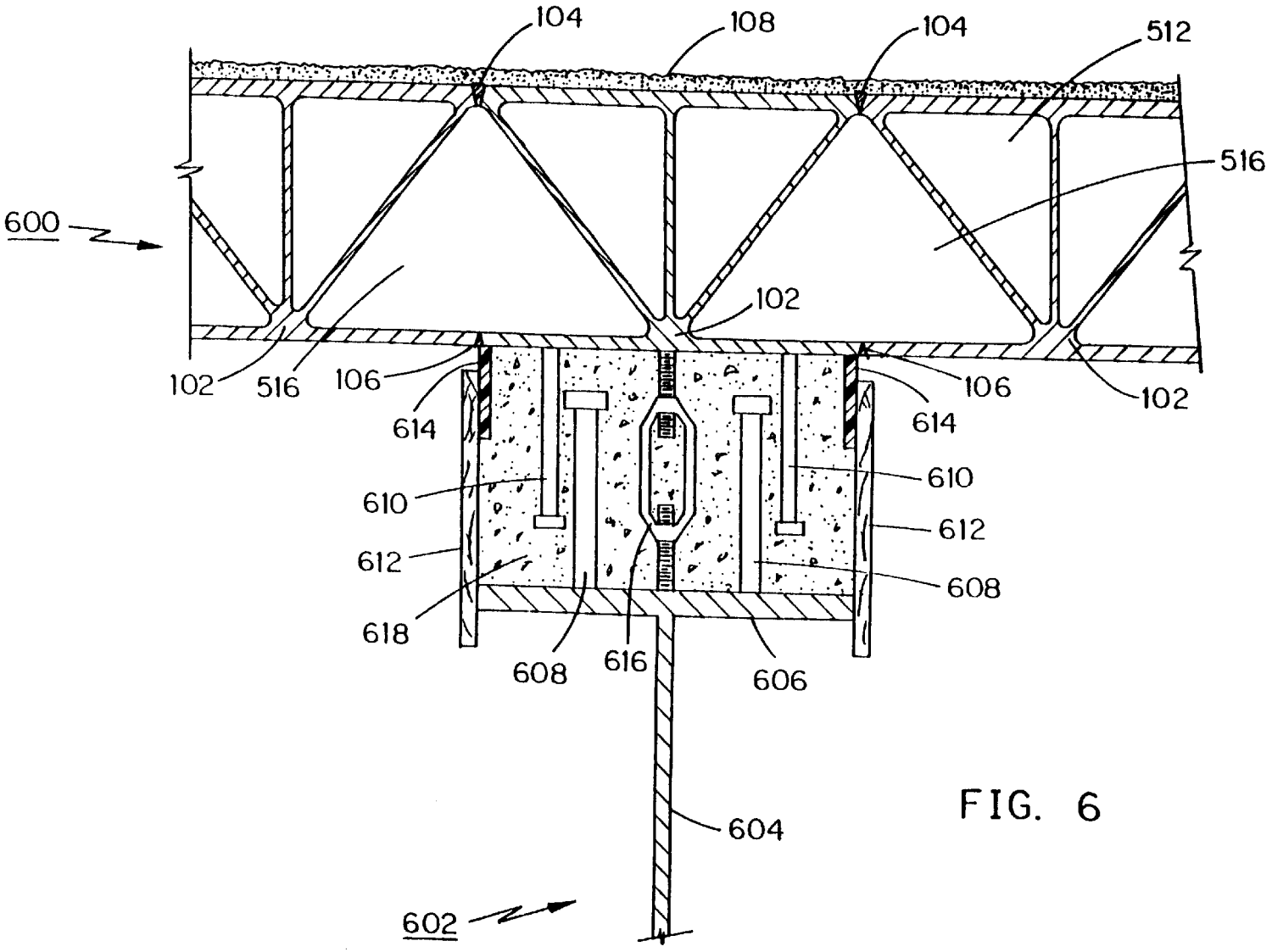
FIG. 6 is a vertical cross-sectional view of a portion of the bridge deck where it is connected to a bridge girder by means of an initially flowable medium capable of transferring a shear force upon being cured.

The bridge deck-to-girder connection using a flowable medium is a means for transferring loads from the prefabricated aluminum bridge deck 600, best seen in FIG. 6, to a bridge girder 602 which has a vertical web 604 and an upper horizontal flange 606. The desired structure is obtained by first attaching shear engagement elements 608, 608, in any conventional manner, to the top of girder flange 606. In the case of redecking projects these shear engagement elements 608 may already be in place. Similarly, a plurality of shear engagement elements 610, 610, spaced so as not to coincide or interfere with shear elements 608, 608, may be attached in any convenient manner to the bottom of bridge deck 600.

Before bridge deck 600 is put in place, aluminum shear studs 610, 610 are attached to the bottom flange of the deck 600. Shear engagement elements 608, 608 are then attached to the upper flange 606 of girder 602. See FIG. 6. Leveling elements 616 are then secured to the tops of the girders in various locations for the purpose of setting the deck elevation. The heights of the leveling elements 616 are set in such a manner as to ensure that the prefabricated panel 600, when resting on the leveling elements 616 will be located at the proper elevation. Next, removable forms 612, 612, with compressible elements 614, 614 provided at the top thereof are attached to the upper flange 606 of girder 602. The goal is to form a temporary but well-sealed space between the upper surface of upper flange 606 of girder 602 and the bottom surface of bridge deck 600, with the various shear engagement devices disposed therebetween. The exact positioning of the bottom surface of deck 600 relative to the upper surface of upper flange 606 can be locally adjusted by any conventional leveling device such as 616 which is eventually left in place embedded in the cured flowable medium. Several such leveling devices may be used as deemed most appropriate under the prevailing circumstances. By judicious use of such devices, even curved and/or crowned bridge deck profiles can be achieved in a manner which is expected to be well understood by persons of ordinary skill in the bridge-building art.

The flowable medium 618 is then flowed into the void defined by the upper surface of upper flange 606 of girder 602 and the forms 612, 612 in sufficient quantity, i.e., to virtually the top of compressible elements 614, 614. The still uncured flowable medium is then vibrated to settle into and within the formed volume. To minimize corrosion, such a flowable medium 618 may be selected to be a polymer-modified product. While the flowable medium 618 is still in its uncured and plastic state, the prefabricated aluminum deck 600, with shear engagement devices 610 attached thereto, is lowered into place so as to have its weight resting on the plurality of leveling devices 616 which have previously been adjusted as needed. As will be obvious, the uppermost edges of the compressible elements 614, 614 will have been positioned so that they will deform slightly when deck 600 is in its final position initially resting on the top of the leveling devices 616. The goal is to ensure that the uncured flowable medium 618 makes extensive contact with the bottom surface of deck 600, and this is facilitated by the compressible nature of compressive elements 614, 614 and proper adjustment beforehand of leveling devices 616. After a suitable period of time, once the flowable medium 618 has cured to its set state to form a rigid connection between bridge deck 600 and girder 602, the form elements 612, 612 may be removed.

The use of such a flowable medium 618, as described above, permits the formation of complex bridge deck geometries without the use of expensive and difficult-to-use shims and adjustment mechanisms, particularly under difficult field conditions and or variations in girder heights/elevations. A deck cross-slope or crown is often necessary to ensure adequate drainage, and vertical curvature in bridge decks is often provided as a smooth continuation of a curved profile in the contiguous roadway but may be required for other reasons as well. Many such geometric requirements can be readily met with the use of simple leveling devices such as 616 and the ease of using a flowable medium 618 to establish the desired connection between the bridge deck 600 and the supporting girders 602.

Note that the use of shear engagement devices such as elements 608 and 610 inexpensively and easily allows for the efficient transfer of shear force between the bridge deck 600 and the supporting girders 602 positioned therebetween. The final strong solid bond enables the bridge deck and the support system of girders to act in an integrated and unified manner, thereby increasing the strength of the overall structure. Ordinary studs, which are relatively inexpensive and are easily placed, may be used as the shear engagement devices 608, 610. Furthermore, since the shear engagement devices 610 are attached to the bottom surface of the bridge deck 600, there is no need to strategically place the bridge deck so as to avoid the heads of conventional fasteners such as through bolts. It is believed that this should give the bridge engineer using this invention greater liberty to place individual elongate elements comprised within the bridge deck in any selected location with respect to the supporting girders.

Note also that because the system as described utilizes shear engagement devices which may readily be made of steel, it can be easily used for deck replacement on bridges which have existing shear studs located on the girder system which is to be used. This alleviates the need for costly and time-consuming removal of existing shear connection devices in the course of upgrading and/or extending existing bridge facilities.

The use of compressible elements or strips 614, 614 at the tops of the removable forms 612, 612 ensures that the concrete or grout in its uncured state will be put in complete and intimate contact with the bottom surface of bridge deck 600, so that there will be sound support by the cured concrete for the bridge deck 600 when the latter is put to use and carries its intended traffic loads.

On redecking projects, after an existing bridge deck has been removed, if the existing girder support system is to remain it must be prepared for attachment to the new bridge deck 600. Conventional attachment methods would require a significant amount of drilling, in the field, through the top flanges of the girders. This may be both costly and time-consuming. Shear studs, however, can be applied rapidly and in many cases may already be present. Furthermore, since they are to be placed initially within the flowable medium, precise location of the studs is not required.

Finally, because the above-described prefabricated bridge deck, when made of aluminum or aluminum alloy, is very light in weight (approximately 20 lbs. per sq. ft), the option exists for the connection between the bridge deck and underlying supportive girders to be made in the shop in those cases where new steel or aluminum girders will be used. In such a circumstance, entire bridge panels, including girders, could be prefabricated, shipped to the final site of use, and installed in a very rapid manner. Because of the emphasis on shop-construction in this instance, there should be a commensurate improvement in inspection, quality control, safety assurance to the ultimate users of the bridge deck, and perhaps even lowered insurance premiums to the bridge builder and/or owner.

As noted earlier, a bridge rail system 118 as generally indicated in FIG. 2 is typically provided along each outer side of the bridge deck to protect people, traffic, and the bridge deck itself against the consequences of collisions. A concrete curb 700 may be cast onto the edge of the deck 600 to intercept misdirected traffic by causing vehicular tires to bump against the curb, thus protecting the bridge rail and immediate supporting structure from contact with the impacting vehicle body. This protects the bridge rails such as 702 from permanent deformation and damage in the majority of potential collisions. Bridge parapet 702 is made of aluminum, steel, or reinforced concrete and is connected to the bridge superstructure through a support system comprising upright bridge rail posts 704 when steel or aluminum rails are used and continuously in the case of reinforced concrete rails. Rail 702 prevents pedestrians and/or vehicles from falling off the bridge. In other words, a concrete curb 700 and the totality of the bridge rail structure 118 may cooperate to minimize the harmful consequences of any collisions on the bridge deck.

The concrete curb 700 may be formed so that it does not make direct contact with the bridge rail posts 704 when these are made of steel or aluminum. This is done by providing a resilient compression seal 706, e.g., one made of neoprene or similar resilient and durable material, which is pressed in place between cast-in-place concrete pedestals 708 and aluminum extrusion end closure plates 710 which are provided to perform the earlier-mentioned function of closing off the ends of the voids in the elongate elements which might otherwise be exposed to entry of animals, birds, and ambient debris.

If and when there is an impact between a vehicle and the above-described protective structure, the tires and wheels of the vehicle will first impact curb 700. The resultant lateral force is resisted by a plurality of aluminum shear angles or studs 712, best seen in transverse cross-section in FIG. 8. There will also be frictional forces between the bottom of curb 700 and the underlying wearing layer 108, tending to resist the lateral force of the impact of the vehicle on the curb.

The preferred aluminum and support post system 118 is intended to protect against more severe collisions, and is provided through the bridge rail 702 and a plurality of supporting bridge rail posts 704 when bridge rail 702 is made. The bridge rail posts 704 are preferably connected to the bridge deck superstructure through a prefabricated support system. Thus, when a vehicle impacts the bridge rail, the consequential impact forces are transferred to and partially resisted by the bridge rail, steel shear studs 716 and the concrete pedestal 708. The impact forces are then transferred through steel bracket 120, gusset plate 718 and stiffener plate 720 into the exterior steel girder 112. Note that there is also provided a diaphragm 122 by which these and other such forces may be transmitted to and shared with adjacent interior girders (not shown) cooperating with girder 112.

All of the components of the above-described bridge rail system are preferably fabricated, i.e., formed, fitted and assembled, in a shop, with the exception of the cast-in place concrete. When necessary and desirable, even such concrete components can be prefabricated and then taken to the site, fitted and installed in known manner. Consequently, the only items which may require extensive field labor are the concrete pedestals 708 and the concrete curbs 700 when aluminum and steel parapets are utilized. High early strength concrete may be employed in forming concrete components in the field to expedite installation and the overall construction process.

The advantages of the above-described bridge rail system may be summarized as follows. The concrete curb 700 is formed, shaped and located to deflect small and glancing vehicular impacts, typically with the tires and wheels of misdirected vehicles. This protects the bridge rail system 118, and most particularly the bridge rail 702, bridge deck 600 and incidental superstructure, from direct impact damage and the need for subsequent repair. The bridge rail 702 is structurally connected to the bridge superstructure at discrete locations via bridge rail support posts 704, concrete pedestals 708, and brackets 120, and it is thus completely isolated from the bridge deck 600 and the upwardly protruding concrete curb 700. This allows large, full vehicular impacts to be safely absorbed by the superstructure without damage to the aluminum deck. Since the bridge rail system is thus comprised primarily of modular components, it can be quickly and easily installed and, after accidental damage, replaced. This reduces field labor, expense, and traffic delays which are inevitably caused by any construction along a busy roadway. The described bridge rail system preferably utilizes extruded aluminum bridge rails 702 and forged aluminum bridge rail support posts 704.

These materials have a proven history as being effective, corrosion-resistant, and visually attractive for such structures. They are also light in weight and can be manufactured in the shop in modular form, and are thus easy to install. The aluminum bridge rail 702 also allows passing motorists the opportunity to view scenery to the sides of the bridge, i.e., the view of a passerby is not impeded thereby.

An important aspect of the present invention is the generation of a relatively large deck panel from simple elongate extruded aluminum elements 102 by connecting them to each other by longitudinal one-side, full-penetration welds. This feature of the invention is best understood with reference to FIG. 11 which also illustrates and explains a preferred mechanical device for forming such welds efficiently, rapidly, and to consistently high standards.

Figure 11:
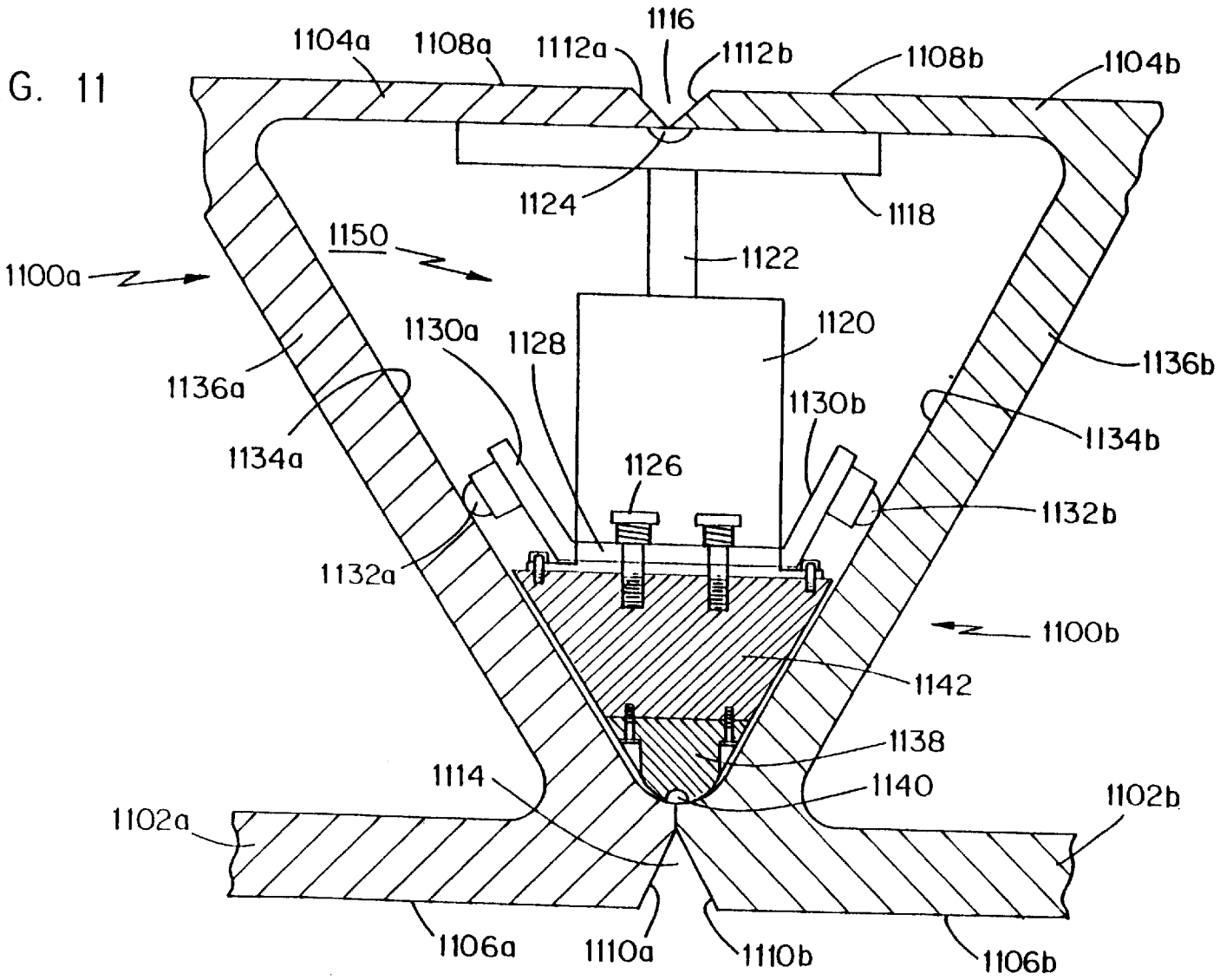
FIG. 11 is a partial vertical cross-sectional view to illustrate the manner of use of a pneumatically or hydraulically positioned removable backing bar for welding elongate hollow shapes.

The reader is cautioned that in FIG. 11 the two longitudinally adjoining elongate elements 102, 102 which are to be welded together are shown "upside-down" as compared to the view in FIG. 10. Since the welding takes place in a "shop", for practical purposes there is no special limitation generated by the terms "up" and "down". It is only when the completed deck panel is to be assembled into the bridge deck that it becomes important to have the upper surface of each panel at the top. The following discussion, therefore, must take this into account to avoid confusion. To assist the reader in minimizing such confusion, each of the important elements and physical features of the structure illustrated in FIG. 11 will be given unique numbers.

Thus, referring to FIG. 11, there are seen in transverse cross-section only the relevant portions of two longitudinally adjoining but unwelded elongate elements 1100*a* and 1100*b* which, as seen in transverse cross-section, have first flanges 1102*a* and 1102*b* and second flanges 1104*a* and 1104*b* which have respective outer flat surfaces 1106*a*, 1106*b* and 1108*a*, 1108*b*. At their outer flange edges, elongate elements 1100*a*, 1100*b* are respectively provided with chamfer surfaces 1110*a*, 1110*b* and 1112*a*, 1112*b*, respectively. Accordingly, when the two elongate elements 1100*a* and 1100*b* are placed side-by-side in contact with each other, they generate two local V-shaped elongate grooves 1114 and 1116 into which are to be formed the so-called "one-side, full penetration welds" as was discussed above in detail.

As persons of ordinary skill in the mechanical arts will readily appreciate, secure positioning of the two cooperating but unwelded elongate elements 1100*a* and 1100*b* as thus described is readily accomplished. What is important, however, is to avoid loss of deposited weld material while in its molten state through the bottoms of the V-shaped grooves 1114 and 1116 (when each is placed with its apex downward to receive molten weld material) while the welds are being formed. To significantly reduce such throughflow of weld material, and to ensure high quality longitudinal welds, a backing bar 1118, made of a material such as anodized aluminum or stainless steel, is inserted below the apex of the upper V-shaped groove, i.e., 1116 in the arrangement per FIG. 11. Bar 1118 is held in place by a cylinder (pneumatic or hydraulic) 1120 generating an upward force on a piston 1122 immediately beneath backing bar 1118. A better controlled and stronger weld is obtained by providing a shallow groove 1124 in the outer surface of backing bar 1118, positioned directly beneath the apex of the V-shaped groove 1116. Thus, molten weld metal deposited into V-shaped groove 1116 melds with the material of flanges 1104*a*, 1104*b* at the inclined surfaces 1112*a*, 1112*b* thereof. Some weld metal will fall through the apex of the V-shaped groove 1116, and will be caught in the shallow groove 1124 therebelow, form a weld bead reinforcement, and become part of the weld between the flanges 1104*a*, 1104*b*. Most of the weld metal will blend in with the parent metal of the two adjacent flanges being melded and will fill the initially V-shaped groove therebetween.

The complete apparatus 1150 which comprises backing bar 1118, cylinder 1120, and piston 1122, also includes a base 1124 of trapezoidal cross-section on which pneumatic cylinder 1120 is mounted by bolts 1126 on an intermediate base 1128 which has two outwardly extended inclined arms 1130*a*, 1130*b*. Small rounded slider contacts 1132*a* and 1132*b* are provided on extensions 1130*a*, 1130*b*, respectively, and are sized and positioned so as to make light sliding contact with inclined inner surfaces 1134*a*, 1134*b* of inclined webs 1136*a*, 1136*b*.

Directly beneath base element 1142 there is provided a second backing bar 1138 which has a rounded surface containing a shallow groove 1140 which is positioned immediately adjacent to the apex of V-shaped groove 1114. As will be immediately apparent, shallow groove 1140 is intended to perform precisely the same kind of function as shallow groove 1124 in backing bar 1118, i.e., to form the weld metal that melts through the apex of the V-shaped groove 1114 into a reinforcing weld bead when welding is being done between inclined surfaces 1110*a*, 1110*b*.

Pneumatic cylinders are preferably utilized, and a conventional pneumatic hose (not shown) may be employed with a shop supply of compressed air to pressurize pneumatic cylinder 1120 after the apparatus 1150 has been pushed into the space between the adjacently held elongate elements 1100*a*, 1100*b*. Application of pneumatic pressure to pneumatic cylinder 1120 will then cause piston 1122 to push upward on backing bar 1118 and, simultaneously, will cause the other backing bar 1138 to press in the opposite direction. Relief of pneumatic pressure will have the opposite effect and permit the operator to pull the apparatus 1150 out once the welds have been made.

As a practical matter, backing bars 1118 and 1138 can be shop elements which may be disposed of after a certain amount of use, and the metal therein may be recycled if desired. The key is that backing bars 1118 and 1138 can be conveniently made to any required length. This means that by insertion of the apparatus 1150 from opposite ends of the essentially triangular cross-sectioned space found between two adjacently placed elongate elements 1100*a,* 1100*b*, high quality, continuous full-penetration welds 1114, 1116 can readily be provided between elongate elements. As will be appreciated, it may be necessary to use more than one pneumatic cylinder like 1120 to hold backing bars 1118 and 1138 in their desired positions, particularly if relatively long elongate elements 1100*a,* 1100*b* are to be welded together as described.

FIG. 12 is a transverse cross-sectional view of an alternative for the previously-discussed form of the basic elongate element such as 102 as discussed above and as illustrated in FIG. 10. In the embodiment per FIG. 12, the basic structural element 1200 has an upper flange 1202 which on both sides has cantilevered end portions 1204, 1204. At the distal edges of these cantilevered portions, about half way through the thickness of the flange, there are provided beveled surfaces 1206, 1206. Thus, when two of these elongate elements are placed side-by-side the corresponding beveled surfaces create a V-shaped groove into which weld metal may be deposited to unite the two elongate elements. Note that in elongate element 1200 there is no transverse web (like 110 in FIG. 10) which is perpendicular to flange 1202.

In element 1200, there is also provided a second flange 1208 of substantially uniform thickness. The outermost 1210, 1212 surfaces of the first and second flanges 1202, 1208 are planar and parallel.

Between first and second flanges 1202, 1208 there are provided four webs 1214, 1216, 1218 and 1220, inclined as indicated in FIG. 12. As shown, webs 1214 and 1220 incline inwardly from their bottoms immediately adjacent the distal edges of second flanges 1208, to join first flange 1202 at junctions 1222, 1224. Internal inclined webs 1216 and 1218 meet each other and the lower flange at a shared lower junction 1226 and they also respectively join first flange 1202 at junctions 1222 and 1224.

In element 1200 there are thus provided three substantially triangular voids, having rounded corners primarily to accomplish smooth transition of stresses with the central triangle having a curved base. When such an element is welded, preferably in the shop, to a similar elongate element by welds provided at the upper beveled surfaces 1206, 1206 and similar lower beveled surfaces 1228, 1228, there will be also be formed other substantially triangular voids (between the welded elements) each having a curved base virtually the same in shape and size as the central void of each individual element 1200. As discussed elsewhere in this description, provision of such uniformly distributed webs between inclined webs generates a very lightweight and easy-to-handle deck having isotropic load-distribution The area of the top flange immediately below the wheel of a truck will experience higher local bending than the adjacent areas of the top flange which are removed from the wheel patch. These local bending moments are highest at junctures 1222 and 1224. It is therefore desirable to thicken the top flange 1202 at these junctures in order to reduce locally induced bending stress. This increased top flange thickness is labeled as "$T_1$", and the smaller thickness, located at the midpoint 1230 and distal edges 1206 of the top flange 1202 are shown as "$t_1$". This "arching" of the top flange 1202 is, as a practical matter, an option only with extruded products such as aluminum.

FIG. 13 is a cross-sectional view of yet another basic elongate element from which deck panels may be made. In this embodiment, there is provided an upper flange 1302 of substantially uniform thickness and a first width, with cantilevered end portions 1304, 1304 which are provided with beveled surfaces 1306, 1308 as shown. Element 1300 also has a lower flange 1310 having a substantially uniform thickness in its central portion, two inclined outer webs 1312, 1314, and two inclined inner webs 1316, 1318.

As discussed earlier with reference to element 1200, if element 1300 is made of an extruded alloy material, the three triangular voids formed by the various inclined webs will have rounded corners and the thickness at the outer edge portions of lower flange 1310, i.e., "H" will very likely be greater than the thickness of "h" of the central portion of lower flange 1310 due to geometry. The result is that the outer edge portions of lower flange 1310 are extremely strong and provide good rigid support to the inclined webs intersecting thereat.

Shown in broken lines through both the upper and lower flanges and the inclined webs therebetween are neutral surfaces as follows: 1320 is the neutral surface for upper flange 1302, 1322 is the neutral surface for lower flange 1310, 1324, 1326, 1328 and 1330 are the respective neutral surfaces for inclined webs 1312, 1314, 1316 and 1318. An important aspect of element 1300 is that neutral surfaces 1322, 1324 and 1328 all intersect at a single straight line 1332 which would be perpendicular to the plane of FIG. 13, i.e., in the longitudinal direction of element 1300. Similarly, neutral surfaces 1322, 1326 and 1330 also all intersect at a single straight line 1334 which would be parallel to line 1332. In the same manner, neutral surfaces 1320, 1328 and 1330 also all intersect at a third straight line 1336 parallel to lines 1332 and 1334. The term "neutral surface" of an element or portion thereof is meant to identify a surface which represents the centroidal or neutral axis of the element. This aspect of the selected shape is called "perfect triangulation", and is considered to be a geometry which is singularly effective in enabling such an element under load to cope with and distribute forces and bending moments acting as a truss.

As will be appreciated, when a deck panel is formed with elements such as 1300, there will as a result of welding at beveled faces 1306, 1308, be a continuous welded upper surface formed of the welded-together upper flanges 1302 of the various elements. There will not, however, be a continuous lower surface as in the embodiment employing elongate elements 102 or 1200. It is this lack of a continuous lower surface that makes the embodiment according to FIG. 13 an orthotropic rather than an isotropic deck. However, for certain applications, the use of elements such as 1300 provides very advantageous deck panels for bridges and other structures. This is particularly true where the deck is required to span and possess substantial strength characteristics in one direction only.

Advantages of the Present Invention

The low dead load of the aluminum deck taught herein facilitates widening of existing bridges without the need to build new substructures. Existing substructures may simply be extended with the use of corbels or similar widening techniques at the top to receive girders for the widened bridge. The low dead load of the bridge deck also results in lower seismic loads acting on the bridge, since seismic forces are directly proportional to the mass of the bridge.

Because the centerlines or neutral surfaces of the web elements of the selected transverse cross-sections of the basic elongate extended elements define triangles, this deck is very strong and stiff in the transverse direction. A triangle is the only shape that can resist loads applied to the points of intersection of the legs without bending at those points or in the legs. The legs of the triangle resist the load by forces directed axially along the legs. Such structural webs are much stiffer against axial forces than they are against bending.

The deck may be attached securely to the bridge girders so that the deck and girders act compositely.

The disclosed deck affords no horizontal areas on the underside of the deck where dirt may accumulate or birds roost.

It may also be made with continuous top and bottom flanges, so that it acts much more like a truly isotropic deck (that is, a deck with similar structural properties, such as strength and stiffness, in both the transverse and longitudinal directions) than an orthotropic deck (that is, a deck with different properties in different horizontal directions).

Although the drawing figures and related detailed description of the structures shown therein all relate to bridge deck applications, this is not intended to be limiting. Persons of ordinary skill in the art will immediately recognize the general utility of the invention in other applications where lightweight modular support is desired, e.g., floors in buildings, mobile homes and for truck beds, temporary platforms as for band-stands and helicopter landing pads, gangways, and portable or re-usable bridges, and the like. The key to such a broad usage of the invention is that aluminum extruded elements are employed to maximum advantage to create extended support elements, largely in a controlled shop environment.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A method of connecting a prefabricated bridge deck to a support girder, comprising the steps of:

mounting first shear force transfer elements to extend from an upper surface of the girder in a first arrangement;

mounting second shear force transfer elements to extend from a bottom surface of the bridge deck in a second arrangement different from said first arrangement;

providing a plurality of leveling elements extending from the upper surface of the girder to define a selected spacing between the upper surface of the girder and the lower surface of the bridge deck;

providing a set of forms along said upper surface of the girder to define a space which contains the first shear force transfer elements and the leveling elements, the forms including compressible upper edge portions;

pouring a quantity of a flowable and curable medium into said space so as to surround the first shear force transfer elements and the leveling elements;

placing the bridge deck so as to support the same by said leveling elements in a manner such that the second shear force transfer elements are submerged in the flowable medium and the bottom surface of the bridge deck contacts the compressible portions of the forms to an extent sufficient to obtain extended contact between the bottom surface of the bridge deck and the uncured flowable medium; and curing the flowable medium, to thereby form a strong shear force transmitting vertical and horizontal support and connection between the girder and the bridge deck.

2. The method according to claim 1, comprising the further step of:

coating the bottom surface of the bridge deck and the second shear force transmitting elements where necessary to provide galvanic isolation thereof from the cured flowable medium and the girder.

3. The method according to claim 1, comprising the further step of:

adjusting said leveling elements, prior to flowing of the flowable medium, to obtain a selected profile of the bridge deck relative to the upper surface of the girder.

* * * * *